US006192957B1

(12) United States Patent
Semba

(10) Patent No.: US 6,192,957 B1
(45) **Date of Patent: *Feb. 27, 2001**

(54) HEAT TRANSFER RECORDING SHEET PRODUCING APPARATUS AND ROLL SHAFT SUPPLYING APPARATUS

(75) Inventor: Yoshikimi Semba, Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/140,423

(22) Filed: Aug. 26, 1998

Related U.S. Application Data

(62) Division of application No. 08/494,934, filed on Jun. 26, 1995, now Pat. No. 5,851,345.

(30) Foreign Application Priority Data

| | | |
|---|---|---|
| Jun. 28, 1994 | (JP) | 6-146620 |
| Jun. 28, 1994 | (JP) | 6-146638 |
| Jul. 28, 1994 | (JP) | 6-176883 |
| Sep. 30, 1994 | (JP) | 6-237153 |

(51) Int. Cl.[7] ..... B32B 31/00; B65H 18/00

(52) U.S. Cl. ..... 156/387; 156/351; 156/359; 156/363; 156/446; 156/456; 156/458; 156/511; 156/522; 156/552; 156/187; 156/192; 242/533.4; 242/532.3; 242/534; 242/523; 242/473.5; 242/473.6; 242/473.9; 242/474; 242/474.1; 34/549; 34/487

(58) Field of Search ..... 156/475, 552, 156/250, 351, 448, 511, 192, 516, 456, 521, 190, 387, 458, 446, 188, 187, 517, 522, 359, 363, 362; 34/549, 487; 242/533, 533.7, 533.4, 532.3, 534, 523, 473.5, 473.6, 473.9, 474, 474.1; 209/517, 518, 538, 576, 577, 912

(56) References Cited

U.S. PATENT DOCUMENTS

| | | | |
|---|---|---|---|
| 2,467,555 | 4/1949 | Hornbostel et al. | 242/533.7 |
| 4,614,045 | 9/1986 | Nagasawa et al. | 34/34 |
| 4,692,196 | 9/1987 | Ellegood et al. | 156/187 |
| 4,962,897 | 10/1990 | Bradley | 242/521 |
| 4,985,292 | 1/1991 | Umise et al. | 428/194 |
| 5,109,795 | 5/1992 | Umise et al. | 118/669 |
| 5,180,607 | 1/1993 | Umise et al. | 427/8 |
| 5,441,567 | 8/1995 | Umise et al. | 118/669 |
| 5,589,321 | 12/1996 | Matsuda | 430/432 |
| 5,851,345 * | 12/1998 | Semba | 156/510 |

* cited by examiner

*Primary Examiner*—Linda L. Gray
(74) *Attorney, Agent, or Firm*—Parkhurst & Wendel, L.L.P.

(57) ABSTRACT

A printing unit in a gravure printing portion prints a plurality of end marks on a web having a base film and a hot melt ink layer. The end marks printed on the web are dried by a drying apparatus. A sheet obtained from the web is wound around a roll shaft in a roll form by a sheet winding apparatus to form a sheet roll. The roll shaft is supplied from a roll shaft supplying apparatus to the sheet winding apparatus, and the sheet roll formed by the sheet winding apparatus is discharged from a discharging apparatus. The discharge apparatus includes a plurality of cradles in the vertical direction, a carry-out conveyor beside the cradles, a guide rail beside the cradles on the opposite side to the conveyor and arranged vertically, and receiving arms horizontally mounted on the rail and corresponding to the cradles. The arms move up and down on the rail and extend or contract horizontally from the cradles.

3 Claims, 13 Drawing Sheets

HEAT TRANSFER RECORDING SHEET PRODUCING APPARATUS AND ROLL SHAFT SUPPLYING APPARATUS

This is a Division of application Ser. No. 08/494,934 filed Jun. 26, 1995 now U.S. Pat. No. 5,851,345.

BACKGROUND OF THE INVENTION

1. Field of the Invention

The present invention relates to a heat transfer recording sheet producing apparatus and a roll shaft supplying apparatus for producing a heat transfer recording sheet used in thermal facsimile devices and the like.

2. Related Background Art

Conventional facsimile devices use a heat transfer recording sheet in the form of a roll. This recording sheet is also called a donor, which has such a structure that a hot melt ink layer consisting of a binder of wax, resins, etc., and a color agent is laid on one surface of a thin, plastic film base, for example, of polyester. The ink layer of the recording sheet is overlaid on paper, and the back face of the recording sheet is heated by a heating means such as a thermal head to transfer ink to the paper, thereby effecting printing. Such facsimile devices are provided with an apparatus for indicating the end of the recording sheet.

For indication of the end of the recording sheet, an end mark with a reflective surface is normally provided in the vicinity of a fixed end (terminal end) of the recording sheet to a roll shaft. This end mark is given on either the hot melt ink layer side or the opposite side thereto of the recording sheet, and is optically detected by a sensor having a light source and a photodetector. This end mark is printed on the recording sheet by flexography or brushing.

However, in case of the end mark being printed by flexography where ink is deposited on the recording sheet using a rubber letterpress plate, the recording sheet would be conceivably crumpled during printing if it is thin.

On the other hand, in case of a small end mark being printed by brushing, there are problems that the quality of marking is poor and that the printing takes a long time.

SUMMARY OF THE INVENTION

The present invention has been accomplished taking account of the above-described points, and an object of the present invention is to provide a heat transfer recording sheet producing apparatus and a roll shaft supplying apparatus by which the end mark can be given to the recording sheet with good quality and good accuracy and a great deal of recording sheets can be produced quickly.

A first feature is a heat transfer recording sheet producing apparatus comprising: a web supplying apparatus for supplying a web having a base film and a hot melt ink layer; a gravure printing apparatus for printing a plurality of end marks at predetermined intervals in a widthwise direction on the web supplied from the web supplying apparatus; a drying apparatus for drying the end marks gravure-printed; a sheet winding apparatus for winding a sheet obtained from the web in a roll form around a roll shaft having a slit at one end thereof to form a sheet roll; a roll shaft supplying apparatus for supplying the roll shaft to the sheet winding apparatus; and a discharging apparatus for discharging the sheet roll formed by the sheet winding apparatus.

A second feature is a heat transfer recording sheet producing apparatus, wherein the drying apparatus has a fan, a heater, and a circulating duct connected to the fan and the heater to circulate hot air and extending to the vicinity of the web, and a slot for making the hot air blow against the each end mark on the web is formed in the circulating duct.

A third feature is a heat transfer recording sheet producing apparatus, wherein the roll shaft supplying apparatus comprises a transferring apparatus for sequentially transferring roll shafts in a horizontal direction; an introducing apparatus connected to an upstream side of the transferring apparatus, for introducing the roll shafts to the transferring apparatus; a discharging apparatus connected to a downstream side of the transferring apparatus, for discharging the roll shafts to a side of a winding portion; a slit detecting apparatus for detecting presence or absence of a slit of a roll shaft, and an orientation of the roll shaft; and a gripping/turning apparatus arranged to operate based on a signal from the slit detecting apparatus in such a manner that if a slit is present in a roll shaft and if an orientation of the sheet roll is correct, the gripping/turning apparatus grips the roll shaft on the transferring apparatus and transfers the roll shaft to the discharging apparatus without changing the orientation and that if a slit is present in a roll shaft and if an orientation of the sheet roll is opposite, the gripping/turning apparatus grips the roll shaft on the transferring apparatus, horizontally rotates the roll shaft about 180 and transfers the roll shaft to the discharging apparatus.

A fourth feature is a heat transfer recording sheet producing apparatus, wherein the sheet winding apparatus comprises a plurality of holding/rotating devices for sequentially moving on an orbit passing a sticking position, a winding position, and a discharging position and rotating as holding the roll shaft from both sides thereof; a sticking apparatus, disposed near the sticking position, for sticking an adhesive along a circumferential direction around an outer periphery of an unused roll shaft held by the holding/rotating device; a cutting apparatus, disposed between the winding position and the discharging position, for cutting a sheet extending between an already wound sheet roll at the discharging position and an unused roll shaft at the winding position; and a press roll, provided near the winding position, for pressing a sheet against an outer periphery of an unused roll shaft held by the holding/rotating device.

A fifth feature is a heat transfer recording sheet producing apparatus, wherein the sheet winding apparatus comprises sheet winding devices arranged in multiple steps in a vertical direction and wherein the discharging apparatus comprises a plurality of sheet roll cradles arranged in multiple steps in the vertical direction corresponding to the steps in which the sheet winding devices are arranged, on each of which a sheet roll from each sheet winding device is to be mounted; a carry-out conveyor provided beside the sheet roll cradles; a guide rail disposed beside the sheet roll cradles on an opposite side to the carry-out conveyor and arranged in the vertical direction; and receiving arms horizontally mounted to the guide rail corresponding to the sheet roll cradles, each receiving arm vertically moving along the guide rail and horizontally extending or contracting, and each receiving arm receiving a sheet roll on the sheet roll cradle to transfer the sheet roll onto the carry-out conveyor.

A sixth feature is a heat transfer recording sheet producing apparatus comprising: a web supplying apparatus for supplying a web having a base film and a hot melt ink layer; a gravure printing apparatus for printing a plurality of end marks at predetermined intervals in a widthwise direction on the web supplied from the web supplying apparatus; and a drying apparatus for drying the end marks gravure-printed; wherein the drying apparatus has a fan, a heater, and a circulating duct connected to the fan and the heater to circulate hot air and extending to the vicinity of the web and a slot for making the hot air blow against the each end mark on the web is formed in the circulating duct.

A seventh feature is a roll shaft supplying apparatus for supplying a roll shaft having a slit at one end thereof to a winding portion for winding a sheet around the roll shaft in a roll form, comprising: a transferring apparatus for sequentially transferring roll shafts in a horizontal direction; an introducing apparatus connected to an upstream side of the transferring apparatus, for introducing the roll shafts to the transferring apparatus; a discharging apparatus connected to a downstream of the transferring apparatus, for discharging the roll shafts to a side of winding portion; a slit detecting apparatus for detecting presence or absence of a slit of a roll shaft, and an orientation of the roll shaft; and a gripping/turning apparatus arranged to operate based on a signal from the slit detecting apparatus in such a manner that if a slit is present in a roll shaft and if an orientation of the sheet roll is correct, the gripping/turning apparatus grips the roll shaft on the transferring apparatus and transfers the roll shaft to the discharging apparatus without changing the orientation and that if a slit is present in a rolls haft and if an orientation of the sheet roll is opposite, the gripping/turning apparatus grips the roll shaft on the transferring apparatus, horizontally rotates the roll shaft about 180 and transfers the sheet roll to the discharging apparatus.

An eighth feature is a sheet winding apparatus for winding a sheet around a roll shaft in a roll form to form a sheet roll, comprising: a plurality of holding/rotating devices for sequentially moving on an orbit passing a sticking position, a winding position, and a discharging position and rotating as holding the roll shaft from both sides thereof; a sticking apparatus, disposed near the sticking position, for sticking an adhesive along a circumferential direction around an outer periphery of an unused roll shaft held by the holding/rotating device; a cutting apparatus, disposed between the winding position and the discharging position, for cutting a sheet extending between an already wound sheet roll at the discharging position and an unused roll shaft at the winding position; and a press roll, provided near the winding position, for pressing a sheet against an outer periphery of an unused roll shaft held by the holding/rotating device, and a sheet roll comprising a roll shaft; a sticking portion provided along a circumferential direction on an outer periphery of the roll shaft; and a sheet wound around the outer periphery of the roll shaft.

A ninth feature is a sheet winding/discharging apparatus comprising: a plurality of sheet winding devices arranged in multiple steps in a vertical direction, each for winding a sheet around a roll shaft to form a sheet roll; a plurality of sheet roll cradles arranged in multiple steps in the vertical direction corresponding to the steps in which the sheet winding devices are arranged, on each of which a sheet roll from each sheet winding device is to be mounted; a carry-out conveyor provided beside the sheet roll cradles; a guide rail disposed beside the sheet roll cradles on an opposite side to the carry-out conveyor and arranged in the vertical direction; and receiving arms horizontally mounted to the guide rail corresponding to the sheet roll cradles, each receiving arm vertically moving along the guide rail and horizontally extending or contracting, and each receiving arm receiving a sheet roll on the sheet roll cradle to transfer the sheet roll onto the carry-out conveyor.

According to the first feature, the web supplied from the web supplying apparatus is sent to the gravure printing apparatus, and then the gravure printing apparatus operates to print a plurality of end marks at predetermined intervals in the widthwise direction in a predetermined region on the web. The end marks printed on the web are then dried by the drying apparatus, thereby obtaining a plurality of heat transfer recording sheets each having their end marks. The sheet winding apparatus winds the heat transfer recording sheet in a roll form around a roll shaft supplied from the roll shaft supplying apparatus to form a sheet roll, and the sheet roll is discharged from the discharging apparatus.

According to the second feature, the drying apparatus circulates the hot air generated by the fan and the heater inside the circulating duct, whereby the temperature of the air in the duct is always kept constant and the hot air can be made to blow against the end marks under constant conditions through the respective slots.

According to the third feature, roll shafts with slits at one end thereof are introduced from the introducing apparatus to the transferring apparatus, and then sequentially are transferring horizontally on the transferring apparatus. When a roll shaft comes to below the slit detecting apparatus, the transferring apparatus stops and the slit detecting apparatus detects presence or absence of a slit in the roll shaft and an orientation of the roll shaft. Then the roll shaft is transferred on the transferring apparatus, and the transferring apparatus stops when the roll shaft comes to below the gripping/turning apparatus. The gripping/turning apparatus operates based on a signal from the slit detecting apparatus in such a manner that if a slit is formed in the roll shaft and if the orientation thereof is correct, it grips the roll shaft to transfer it to the discharging apparatus without changing the orientation and that if a slit is formed in the roll shaft and if the orientation of the roll shaft is opposite, it grips the roll shaft to horizontally rotate it about 180 and transfers it to the discharging apparatus.

According to the fourth feature, the both ends of an unused roll shaft are held and rotated by the holding/rotating apparatus located at the sticking position on the orbit. Next, the sticking apparatus performs sticking along the circumferential direction on the outer periphery of roll shaft and thereafter holding/rotating apparatus holding the roll shaft moves to the winding position. At the same time, the sheet roll already wound at the winding position moves to the discharging position. Then the cutting apparatus cuts the sheet extending between a sheet roll at the discharging position and an unused roll shaft at the winding position. At the winding position the cut sheet is urged against the outer periphery of the unused roll shaft by the press roll to be fixed thereto, and thereafter the holding/rotating apparatus rotates the roll shaft to wind the sheet around the outer periphery of the roll shaft, thereby obtaining a sheet roll.

According to the fifth feature, the sheet is wound around the outer periphery of a roll shaft to form a sheet roll in each of the sheet winding devices arranged in multiple steps. The sheet roll obtained by each sheet winding devices is mounted on each of the sheet roll cradles arranged in multiple steps corresponding to the arrangement steps of the sheet winding devices. Then the receiving arms provided corresponding to the respective sheet roll cradles ascend along the guide rail in a retracted state so as to lift up the sheet roll mounted on the sheet roll cradle in each step. Then each receiving arm extends to the carry-out conveyor and then descends. Thus, the receiving arms mount the sheet rolls in order onto the carry-out conveyor.

According to the sixth feature, the web supplied from the web supplying apparatus is fed to the gravure printing apparatus, and the gravure printing apparatus operates to print a plurality of end marks at predetermined intervals in the widthwise direction in a predetermined region on the web. The end marks printed on the web are then dried by the drying apparatus, thereby obtaining a plurality of heat transfer recording sheets each with end mark. In the drying apparatus, the hot air generated by the fan and the heater is circulated in the circulating duct, whereby the temperature of the air in the duct is always kept constant and the hot air can be always made to blow against the end marks under constant conditions through the slots.

According to the seventh feature, roll shafts with slits at one end thereof are introduced from the introducing apparatus to the transferring apparatus, and then sequentially are transferred horizontally on the transferring apparatus. When a roll shaft comes to below the slit detecting apparatus, the transferring apparatus stops and the slit detecting apparatus detects presence or absence of a slit in the roll shaft and an orientation of the roll shaft. Then the roll shaft is transferred on the transferring apparatus, and the transferring apparatus stops when the roll shaft comes to below the gripping/turning apparatus. The gripping/turning apparatus operates based on a signal from the slit detecting apparatus in such a manner that if a slit is formed in the roll shaft and if the orientation thereof is correct, it grips the roll shaft to transfer it to the discharging apparatus without changing the orientation and that if a slit is formed in the roll shaft and if the orientation of the roll shaft is opposite, it grips the roll shaft to horizontally rotate it about 180 and then transfers it to the discharging apparatus.

According to the eighth feature, the both ends of an unused roll shaft are held and rotated by the holding/rotating apparatus located at the sticking position on the orbit. Next, the sticking apparatus performs sticking along the circumferential direction on the outer periphery of roll shaft and thereafter the holding/rotating apparatus holding the roll shaft moves to the winding position. At the same time, the sheet roll already wound at the winding position moves to the discharging position. Then the cutting apparatus cuts the sheet extending between a sheet roll at the discharging position and an unused roll shaft at the winding position. At the winding position the cut sheet is urged against the outer periphery of the unused roll shaft by the press roll to be fixed thereto, and thereafter the holding/rotating apparatus rotates the roll shaft to wind the sheet around the outer periphery of the roll shaft, thereby obtaining a sheet roll.

According to the ninth feature, the sheet is wound around the outer periphery of a roll shaft to form a sheet roll in each of the sheet winding devices arranged in multiple steps. The sheet roll obtained by each sheet winding device is mounted on each of the sheet roll cradles arranged in multiple steps corresponding to the arrangement steps of the sheet winding devices. Then the receiving arms provided corresponding to the respective sheet roll cradles ascend along the guide rail in a retracted state so as to lift up the sheet roll mounted on the sheet roll cradle in each step. Then each receiving arm extends to the carry-out conveyor and then descends. Thus, the receiving arms mount the sheet rolls in order onto the carry-out conveyor.

DESCRIPTION OF THE PREFERRED EMBODIMENTS

Figure 1:
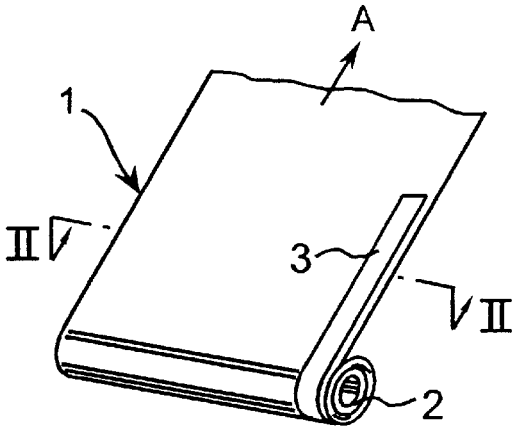
FIG. 1 is a perspective view to show a heat transfer recording sheet having an end mark, which is obtained by a producing apparatus of heat transfer recording sheet according to the present invention.

The heat transfer recording sheet is first described referring to FIG. 1. As shown in FIG. 1, the heat transfer recording sheet drawn out from a roll shaft 2 is pulled in the direction of arrow A up to a state where a small part of the sheet remains on the side of the roll shaft 2.

Figure 2:
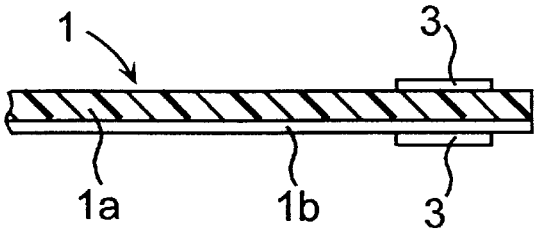
FIG. 2 is a cross section along II—II line in FIG. 1.

As shown in FIG. 2, which is a cross section along II—II line in FIG. 1, the recording sheet 1 has a base film 1*a,* and a hot melt ink layer 1*b,* provided on one face of the base film 1*a,* for recording of copy as aimed by heat transfer. Among them, the base film 1*a* is made of a plastic such as polyester, polypropylene, cellophane acetate, or polycarbonate, or a paper such as a condenser paper or paraffin paper. Among them a polyester base film 1*a* is preferred. The hot melt ink layer 1*b* is made of a mixture of a known pigment, a synthetic resin, and a wax. This hot melt ink layer has a thickness of 3 to 8 microns.

As shown in FIG. 1 and FIG. 2, a narrow end mark 3 is provided along the longitudinal direction and in a portion located at a predetermined distance from the fixed end of the recording sheet 1 to the roll shaft 2. Although this end mark 3 is provided on the side of the base film 1*a,* it may be provided on the side of the hot melt ink layer 1*b*.

The end mark 3 is a light reflecting layer having a thickness of 1 to 6 microns, printed by gravure printing. Thus, the end mark is silvery or golden, whereby it covers the black base film or the hot melt ink layer and forms an effective reflective surface.

Inks for gravure printing possible used for formation of end marks 3 are as follows.

| Gravure Printing Ink 1 | |
|---|---|
| aluminum paste | 13% |
| "VA-HR430" (trade name) | 87% |
| wherein VA-HR430 consists of: | |
| vinylidene fluoride | 8.7% |
| fluorocarbon | 6.5% |
| methyl ethyl ketone | 47.0% |
| toluene | 9.6% |
| "M-AT BC TF" (trade name) | 21.7% |
| "M-AT Mark FC113" (trade name) | 6.5% |

Here, "M-AT BC TF" consists of 10% of Teflon (trade name) powder (polytetrafluoroethylene), 40% of acrylpolyol, 30% of methyl ethyl ketone, and 20% of an additive. Also, "M-AT Mark FC113" consists of 30% of a graft polymer wax, 65% of toluene, and 5% of ethyl acetate.

| Gravure Printing Ink 2 | |
|---|---|
| aluminum paste | 8% |
| nitrocellulose | 16.5% |
| ester gum | 3.0% |
| wax | 4.5% |
| castor oil | 3.0% |
| dioctylmalate | 3.0% |
| toluene | 20.0% |
| isopropyl alcohol | 14.0% |
| ethyl alcohol | 28.0% |
| Gravure Printing Ink 3 | |
| gravure printing ink 2 | 64.0% |
| ["CM950White"](trade name) | 36.0% |

"CM950White" (trade name) contains 24% of aluminum oxide, 26.0% of varnish, and 14.0% of wax.

Figure 3:
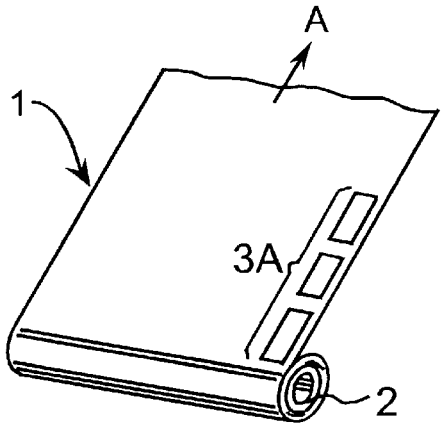
FIG. 3 is a drawing, similar to FIG. 1, to show another heat transfer recording sheet.

A second end mark 3A may be provided at a farther point than the first end mark 3 with respect to the fixed end of the recording sheet 1 to the roll shaft 2, as shown in FIG. 3. The second end mark 3A is formed in a series of relatively short strip patterns by gravure printing. This second end mark 3A is for informing a user of approaching the end of recording sheet 1 before the first end mark 3.

Figure 4:
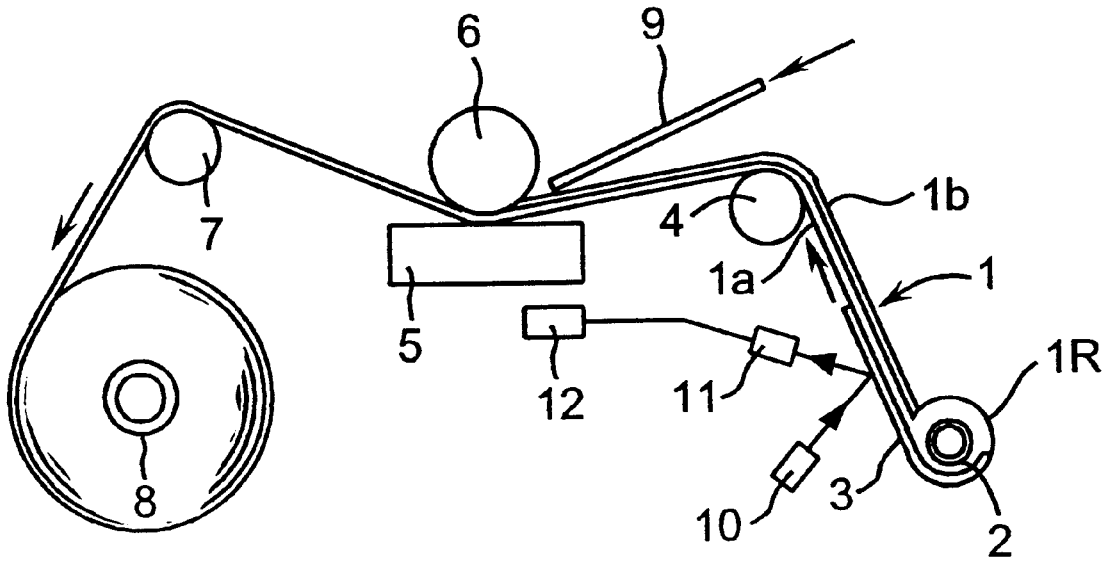
FIG. 4 is a schematic drawing to show a state for optically detecting an end mark provided on a heat transfer recording sheet.

Next described with FIG. 4 is a method for using the heat transfer recording sheet 1. As shown in FIG. 4, the heat transfer recording sheet 1 drawn out of a supply roll 1R of roll shaft 2 moves past a guide roll 4 in the arrow direction and then goes into between a thermal head 5 and a backup roll 6. After that, the heat transfer recording sheet 1 moves past another guide roll 7 and then is wound up by a winding roll shaft 8.

A piece of paper 9 for recording is supplied from a sheet supply tray (now shown) to be laid on the recording sheet 1. While the paper 9 and sheet 1 move in contact with each other between the thermal head 5 and the backup roll 6, heating of the thermal head causes the hot melt ink to be thermally transferred onto the paper 9 to effect recording thereon.

When the recording sheet 1 is pulled up to the vicinity of the fixed end on the supply roll shaft, the reflective end mark 3 appears as shown in FIG. 1. As shown in FIG. 4, this end mark 3 reaches a position where it is opposed to an infrared sensor composed of a light source 10 and a photodetector 11. Infrared rays emitted from the light source 10 reach the end mark 3 to be reflected thereby and then reach the photodetector 11. In this manner the infrared sensor detects the end of sheet 1. An alarm 12 is connected to the photodetector 11 and gives an alarm indicating that the recording sheet 1 is approaching the end when the end mark 3 is detected.

Figure 5:
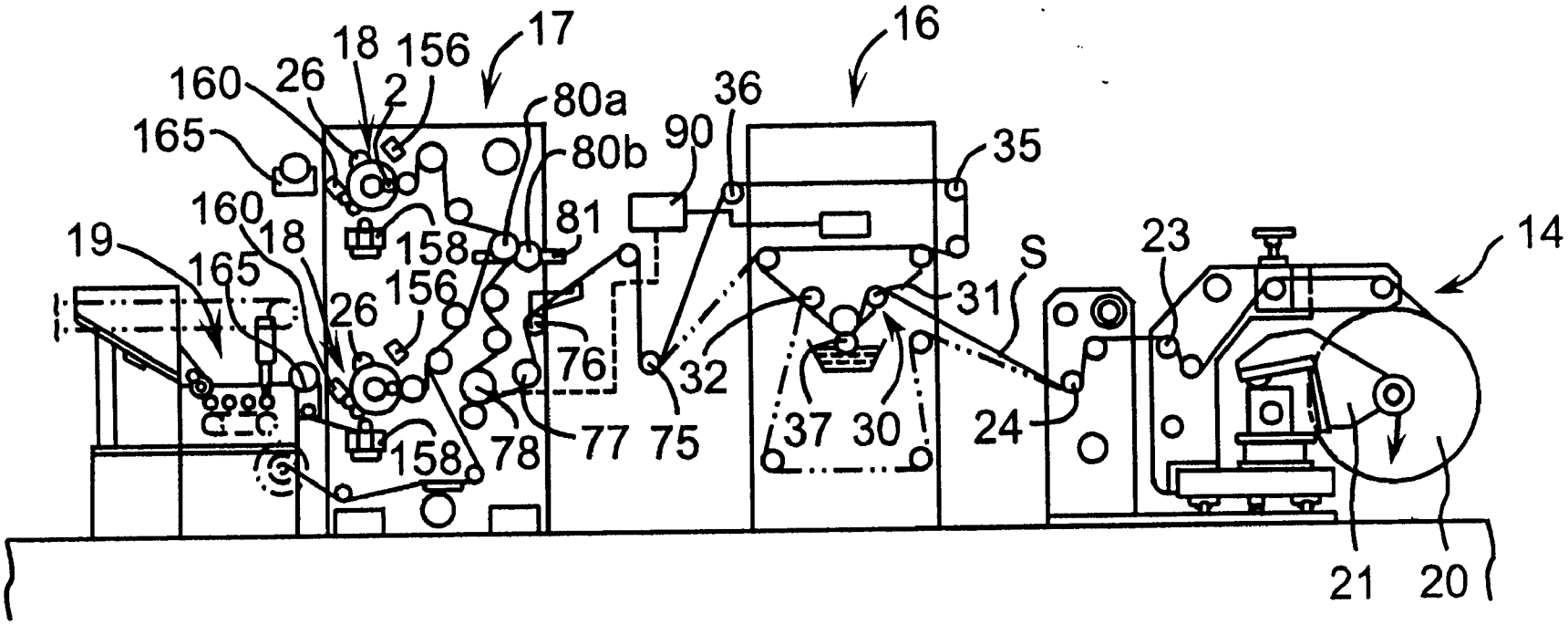
FIG. 5 is a schematic drawing of the producing apparatus of heat transfer recording sheet according to the present invention.

A producing apparatus of the above heat transfer recording sheet is next described referring to FIG. 5 to FIG. 18. As shown in FIG. 5, the producing apparatus is provided with a web supply portion 14, a gravure printing portion 16, a slit portion 17, a sheet winding apparatus 18, and sheet roll cradles 165. Near the sheet winding apparatus 18 there is provided a roll shaft supplying apparatus 19 for supplying the roll shaft 2 to the sheet winding apparatus 18. The sheet winding apparatus 18 includes four winding devices in total, two each in upper and lower steps, on the downstream side of the slit portion 17.

The web S fed out from the supply portion 14 is to become the recording sheet 1. The web S has the base film 1*a* and the coating 1*b* formed on one face of the film and containing the hot melt ink, and the end mark 3 is not formed on the web S yet at this step. Further, the web S has a width two or more times wider than that of the recording sheet 1. FIG. 5 shows a state in which the web is supported in the form of a roll 20 on a roll support 21 in the web supplying portion 14. In FIG. 5, the web S is guided from the supplying portion 14 by a series of guide rolls 23, 24 to bed to the gravure printing portion 16.

In the gravure printing portion 16, the end mark 3 is printed on each web S, for example in four columns. The second end mark 3A shown in FIG. 3 may be printed in the gravure printing portion 16.

After the end mark 3 is printed together with the second end mark 3A or after only the end mark 3 is printed without the second end mark 3A, the web 3 is fed to the slit portion 17, where the wide web S is slit in the longitudinal direction into a plurality of narrow strips. The narrow strips of recording sheet are wound up as sheet rolls 26 in the winding portion 18.

The series of guide rolls 23, 24 as described above and other rolls compose a combinational supplying means for continuously supplying the web. A known apparatus can be applied to the web supplying portion 14.

Next described are the gravure printing portion 16 and the slit portion 17.

Figure 6:
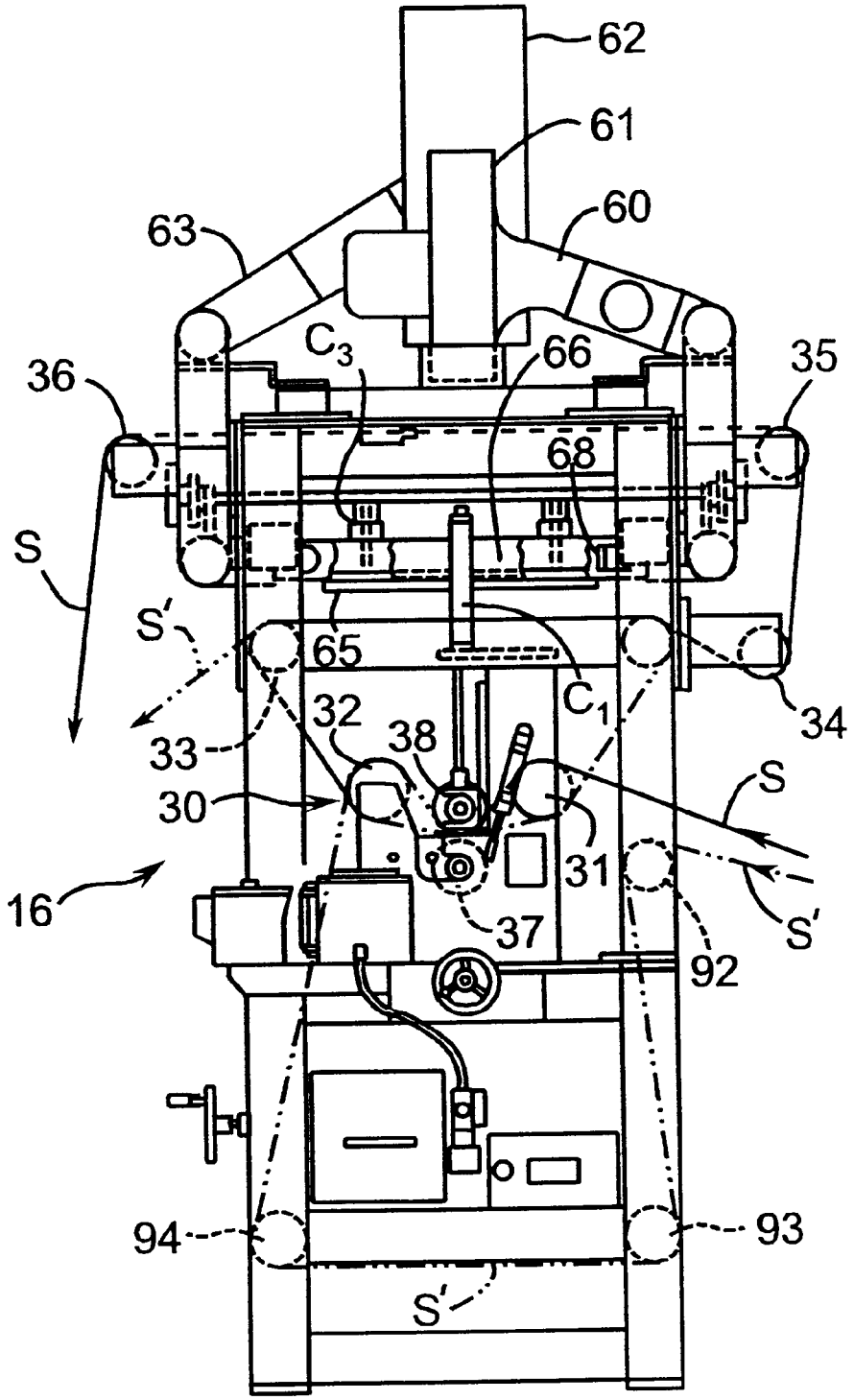
FIG. 6 is an enlarged drawing of a gravure printing portion in the producing apparatus of heat transfer recording sheet shown in FIG. 5.
Figure 7:
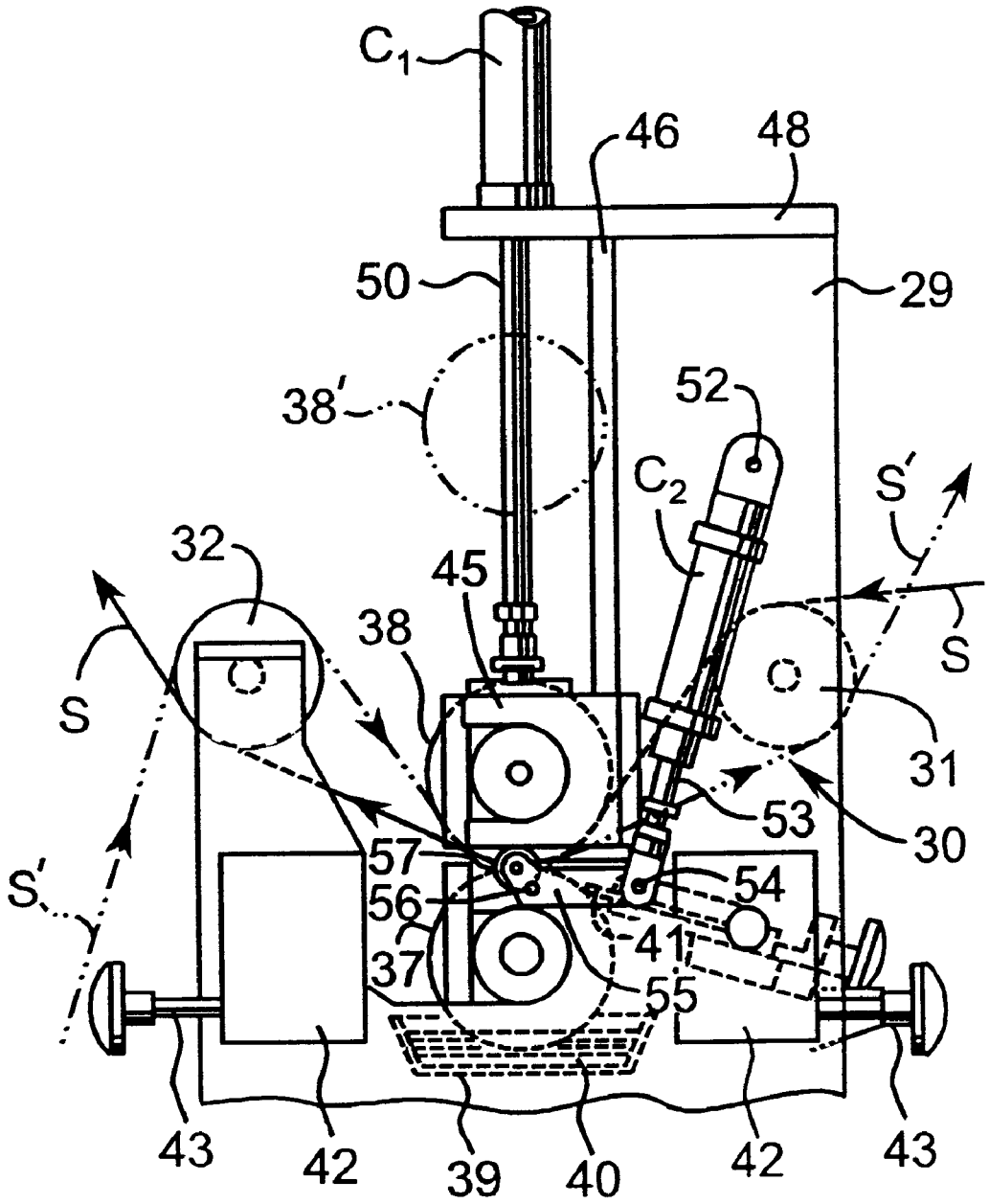
FIG. 7 is another partially enlarged drawing of the gravure printing portion.

FIG. 6 shows the detailed structure of the gravure printing portion 16. As shown in FIG. 6, the gravure printing portion 16 has a frame 29 to which a gravure printing unit 30 is mounted. The web S is supplied via the guide roll 24 (FIG. 5) and another guide roll 31 to the printing unit 30. On the downstream side of the printing unit 30, the web S runs via guide rolls 32, 33, 34, 35, and 36 then to leave the printing portion 16. FIG. 7 is a further detailed drawing of the printing unit 30. As shown in FIG. 7, the printing unit 30 is provided with a plate cylinder 37, an impression cylinder 38, and an ink pan 39 located below the plate cylinder 37. The ink pan 39 reserves the gravure printing ink 40 and the plate cylinder 37 is partially immersed in the ink.

The plate cylinder 37 has a lot of gravure ink cells formed for printing of desired end marks on the web S, and a pair of doctor blade mounting apparatus 42 are provided on either side of the plate cylinder 37. Each mounting apparatus 42 supports a blade 41 for scraping excessive ink off from the surface of the plate cylinder 37.

These doctor blade mounting apparatus 42 each has their doctor blade adjusting knobs 43, and a pressing force of the doctor blade 41 is adjusted relative to the surface of the plate cylinder 37 by the knob 43. Either one of the two doctor blades 41 is used in actual printing works.

Figure 8:
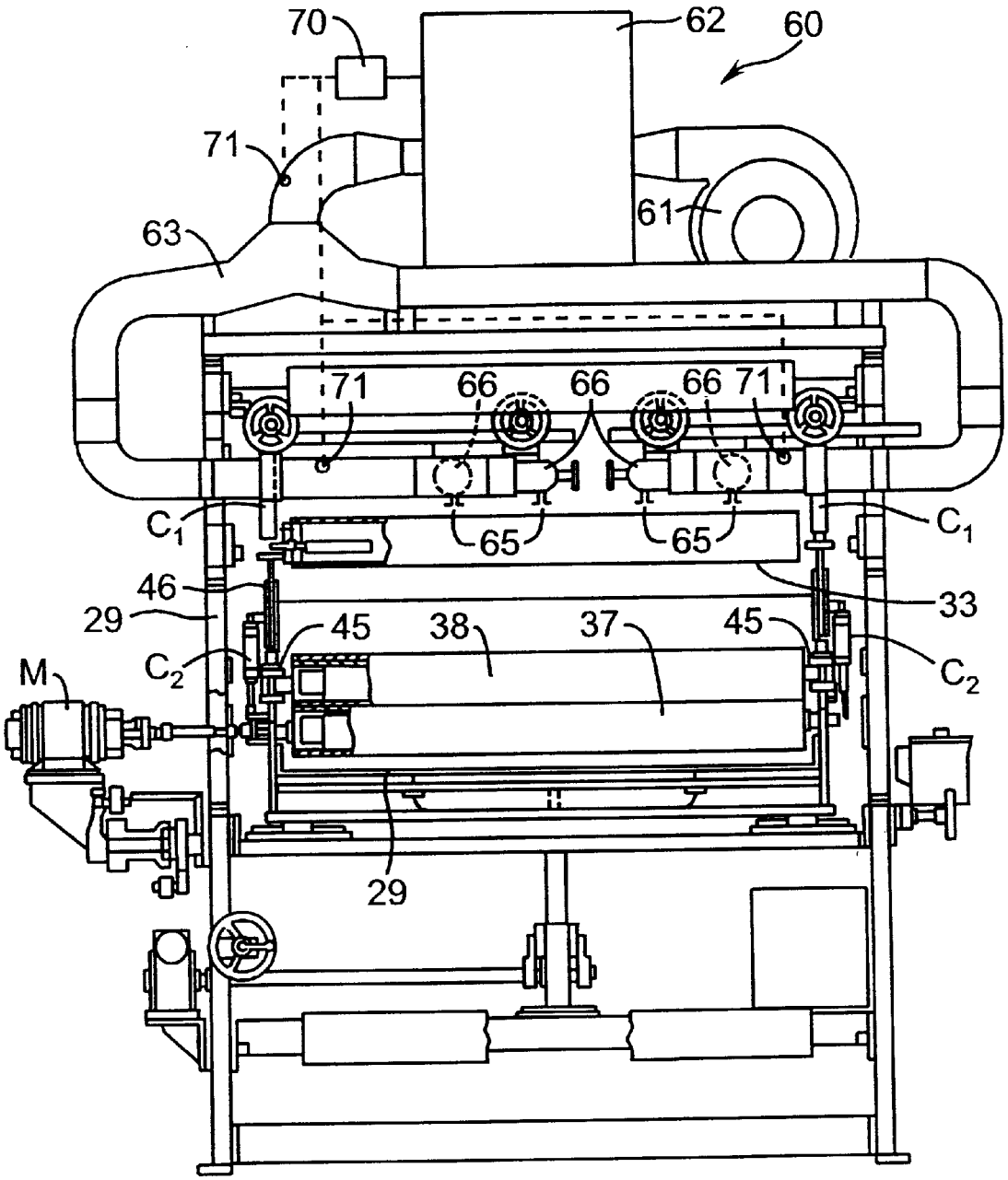
FIG. 8 is a left side view of the gravure printing portion shown in FIG. 6.

As shown in FIG. 8, the impression cylinder 38 is firmly attached to a shaft, and the both ends of this shaft are rotatably supported by a pair of bearing blocks 45. The bearing blocks 45 are arranged as vertically movable along respective upright guide rails 46. Thus, the impression cylinder 38 per se is movable vertically to the plate cylinder 37.

As shown in FIG. 7, a pair of air cylinders C1 are attached to a support 48 for connecting the pair of guide rails 46 so as to cause a vertical displacement of a relatively long stroke of the impression cylinder 38. A piston rod 50 extends downward from the each air cylinder C1 and the each piston rod 50 is connected to the bearing block 45. The air cylinders C1 are pulled in upon exchange of the plate cylinder 37 to raise the impression cylinder 38 up to the position indicated by 38' in FIG. 7.

As shown in FIG. 7 and FIG. 8, another pair of air cylinders C2 are connected at the upper ends 52 thereof to the frame 29 so as to be rockable. A piston rod 53 of each air cylinder C2 is rockably connected to one end of a lever 55 through a connection pin 54. Each lever 55 is connected to the frame 29 so as to be pivotable about a middle point 56, and the each lever 55 supports a roller 57 at the other end. The rollers 57 on the pair of levers 55 are engaged with the bottom surfaces of respective bearing blocks 45. Thus, when the cylinders C2 extend, the levers 55 rotate clockwise so as to raise the bearing blocks 45, thereby separating the impression cylinder 38 from the plate cylinder 37.

Similarly as in known gravure printing machines, the web S runs past the guide roll 31, then past between the plate cylinder 37 and the impression cylinder 38, and past underneath the guide roll 32 toward the downstream.

As shown in FIG. 8, a suitable drive mechanism M is connected to the plate cylinder 37 to supply a rotation drive force to the plate cylinder 37. In order to achieve printing on the web, the plate cylinder 37 needs to rotate so as to supply the web S to the printing unit 30 and also to lower the impression cylinder 38 to achieve engagement of the web S between the impression cylinder 38 and the plate cylinder 37 therewith. For this purpose, the pair of air cylinders C2 are pulled in in order to lower the impression cylinder 38, thereby setting the printing unit 30 in a desired operation state.

As shown in FIG. 6, the drying apparatus 60 is set above the printing unit 30. The drying apparatus 60 has a fan 61 attached to an upper part of frame 29, an air heater 62 connected to the fan 61, and a duct 63 which circulates an air flow generated by the fan 61 and heated by the heater 62 and which extends up to the vicinity of the web.

The duct 63 extending from the air heater 62 returns to the fan 61 as described above, thereby circulating hot air. Four cylindrical outlet tubes 66 extending in the feeding direction of web S are provided in the central portion of a passage of the duct 63. The outlet tubes 66 are prepared corresponding in number to the four columns of end marks 3 printed on the web S, and a slot 65 for applying the hot air to the end mark 3 printed on the web S is formed along the feeding direction of web S at the lower end of each outlet tube 66. Further, thermometers 71 are installed on the entrance side of the outlet tubes 66 or in the connecting portion between the duct 63 and the air heater 62, and a temperature controller 70 controls the air heater 62 at a constant temperature, based on signals from the thermometers 71.

Figure 9:
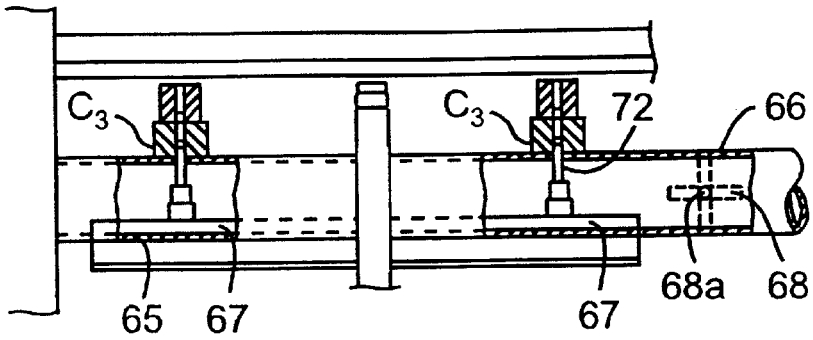
FIG. 9 is a drawing to show an outlet tube portion of a drying apparatus.
Figure 10A:
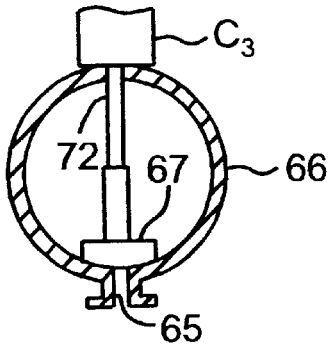
FIGS. 10A and 10B are drawings to show a shutter provided in the outlet tube.
Figure 10B:
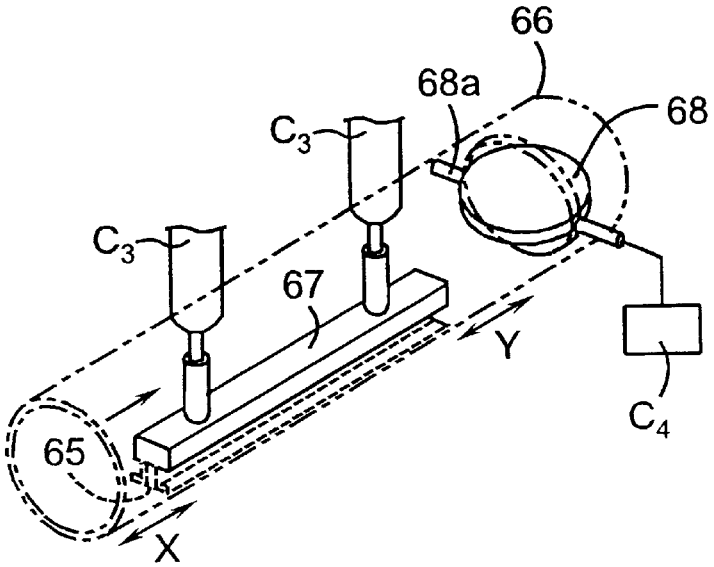

As shown in FIG. 9 and FIGS. 10A, 10B, the slot 65 of each outlet tube 66 is arranged to be covered by an elongate shutter 67 set in the outlet tube 66 and extending in the longitudinal direction thereof. The each elongate shutter 67 is vertically moved through rods 72 by a pair of air cylinders C3 provided above the each outlet tube 66 to open or close the slot 65.

A circular baffle 68 for shutting the passage in the outlet tube 66 is provided inside the each outlet tube 66 and on the downstream side of the slot 65, and the baffle 68 is arranged to rotate about a rotational shaft 68*a* perpendicular to the direction of air flow. This rotational shaft 68*a* is rotated by a drive mechanism C4 operating in synchronization with the air cylinders C3.

During normal operation, the air cylinders C3 keep the shutter 67 down to close the slot 65 and the drive mechanism C4 keeps the baffle 68 in a horizontal state in the outlet tube 66. When the end mark 3 printed on the web S reaches below the slot 65, the air cylinders C3 raise the shutter 67 to open the slot 65. At the same time as it, the drive mechanism C4 rotates the baffle 68 about the rotational shaft 68*a* in the outlet tube 66 up to the vertical position to hinder the flow of hot air.

In this manner almost all hot air in the outlet tubes 66 can blow against the end marks 3 on the web S through the slots 65, thereby effectively drying the end marks 3. During the normal operation the shutters 67 close the slots 65 and the baffles 68 are maintained horizontal, whereby the hot air can be circulated in the duct 63. In this case, because the air heater 62 is under the control at a constant temperature by the temperature controller 70, based on signals from the thermometers 71, the temperature inside the outlet tubes 66 can be maintained nearly constant and upon opening of the slots 65 the hot air at constant temperature can be quickly made to blow against the end marks 3.

Figure 11:
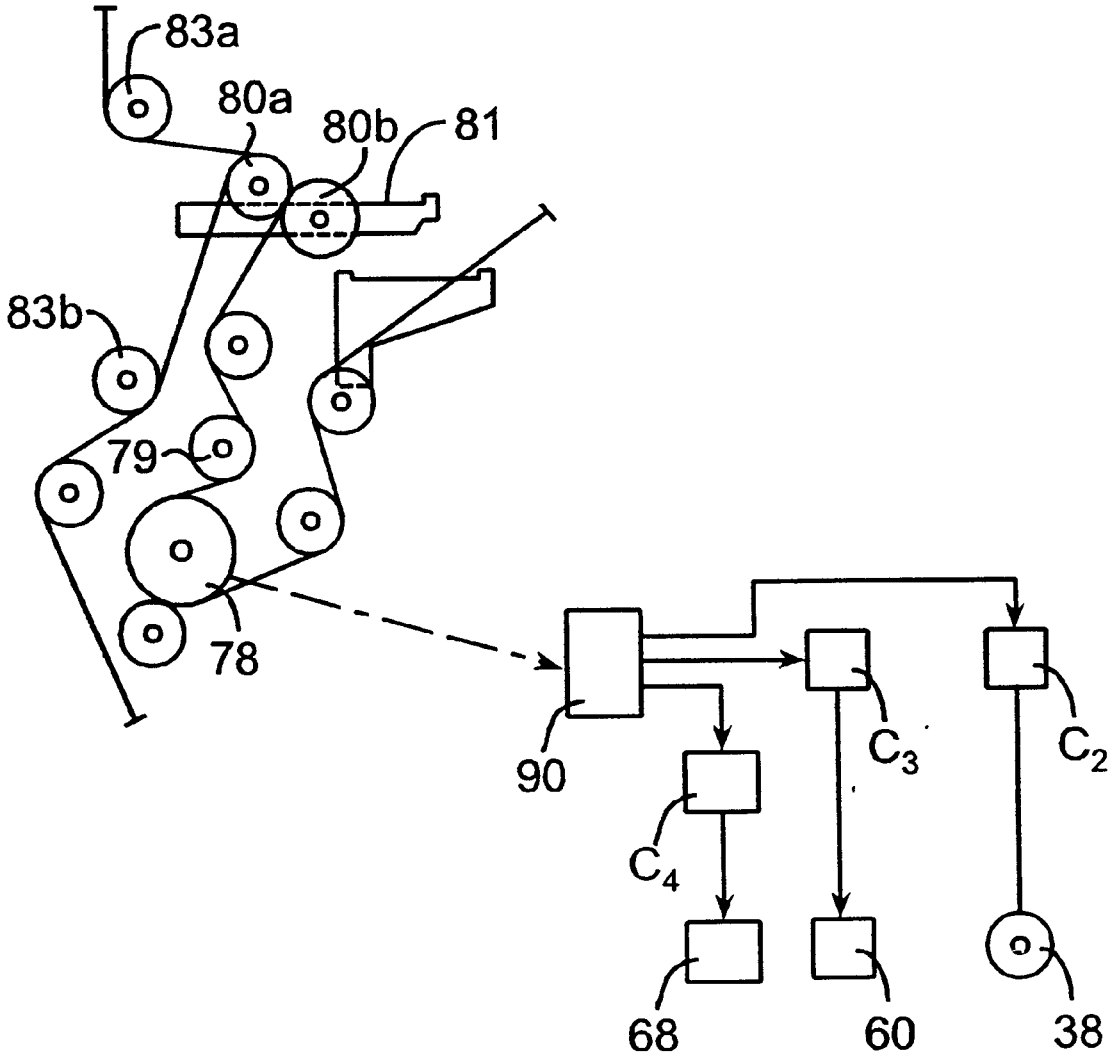
FIG. 11 is a drawing to show a number-of-revolutions detecting circuit for detecting revolutions of a slit part and a master roll in the producing apparatus of heat transfer recording sheet shown in FIG. 5.

After the end marks are printed on the web S in the printing portion 16 and then dried, the web S is guided to the slit portion 17 by a guide roll 75. The slit portion 17 is a known apparatus, and the web S travels from the guide roll 75 to additional guide rolls 76, 76 and thereafter to a master roll 78. Then, as shown in FIG. 11, the web S advances past a guide roll 79 toward a pair of slit rolls 80*a*, 80*b*. One slit roll 80*a* rotates about a stationary shaft while the other slit roll 80*b* is mounted on a movable arm 81 so as to be rotatable. The slit roll 80*a* on the stationary shaft has, for example, known annular slit blades, and strips of recording sheet obtained by slitting the web S are conveyed from the slit portion 17 via either one of two separation rolls 83*a*, 83*b* to be wound up by the recording sheet winding portion 18 to form sheet rolls 26.

As shown in FIG. 5 and FIG. 11, in the vicinity of the master roll 78 there is provided a number-of-revolutions detecting circuit 90 for detecting revolutions of the master roll and the length of supplied web S thereby. The number-of-revolutions detecting circuit 90 is arranged to calculate pulses corresponding to a number of revolutions of the master roll 78. When the pulses reach a preset number corresponding to a start of printing of end mark and indicating a desired position of web s, the pair of air cylinders C2 withdraw to drop the impression cylinder 38, which has been kept apart from the plate cylinder 37. The web S is thus pinched between the plate cylinder 37 and the impression cylinder 38 and printing of end marks is started.

The number-of-revolutions detecting circuit 90 can also detect that the four columns of end marks 3 printed on the web S reach the drying apparatus 60, whereby the air cylinders C3 shrink to raise the shutters 67 so as to blow the hot air against the end marks 3 through the slots 65 of the outlet tubes 66. At the same time as it, the drive mechanism C4 rotates the baffles 68 to the vertical position to interfere the passage in the outlet tubes 66, whereby the almost all hot air in the outlet tubes 66 can be made to blow against the end marks 3.

After the four columns of end marks 3 have passed the slots 65, the air cylinders C3 drop the shutters 67 under the control of the number-of-revolutions detecting circuit 90 to close the slots 65, and the drive mechanism C4 rotates the baffles 68 to the horizontal position.

As shown in FIG. 10B, when the fore end of each column of end mark 3 comes to a point at a predetermined distance X on the upstream side of the outlet slot 65, the shutter 67 opens the slot 65. When the rear end of each end mark comes to the point at the predetermined distance Y on the downstream side of outlet slot 65, the shutter 67 closes the slot 65. The open or close operation of these shutters 67 are carried out under the control of the number-of-revolutions detecting circuit 90.

In the gravure printing portion 16 the four columns of end marks 3 are printed at predetermined positions of each web S by the printing unit 30 in the described manner, and then the drying apparatus 60 dries only the end marks 3 in order to avoid giving negative effects on the other web portions. Next, the slit portion 17 slits respective portions of the printed web in the longitudinal direction to form a plurality of, or example four, heat transfer recording sheets 1 each having a desired width. These recording sheets 1 are wound up by the sheet winding apparatus 18 to form sheet rolls 26.

As shown in FIG. 2, the end mark 3 may be provided either on one face of the base film 1*a* or on one face of the hot melt ink layer 1*b* disposed on the other face of the base film 1*a*. Which face of web S is provided with the end mark 3 is determined depending upon whether the web passes a passage represented by the solid line in FIG. 6 or a passage represented by the chain double-dashed line. In case of the passage of the chain double-dashed line, the web S advances past additional guide rolls 92, 93, 94 and the guide roll 32, then past between the plate cylinder 37 and the impression cylinder 38, and past the guide roll 31. The roll shaft supplying apparatus 19 is next described referring to FIG. 5, FIG. 12, FIG. 13, and FIGS. 14A–14C.

Figure 12:
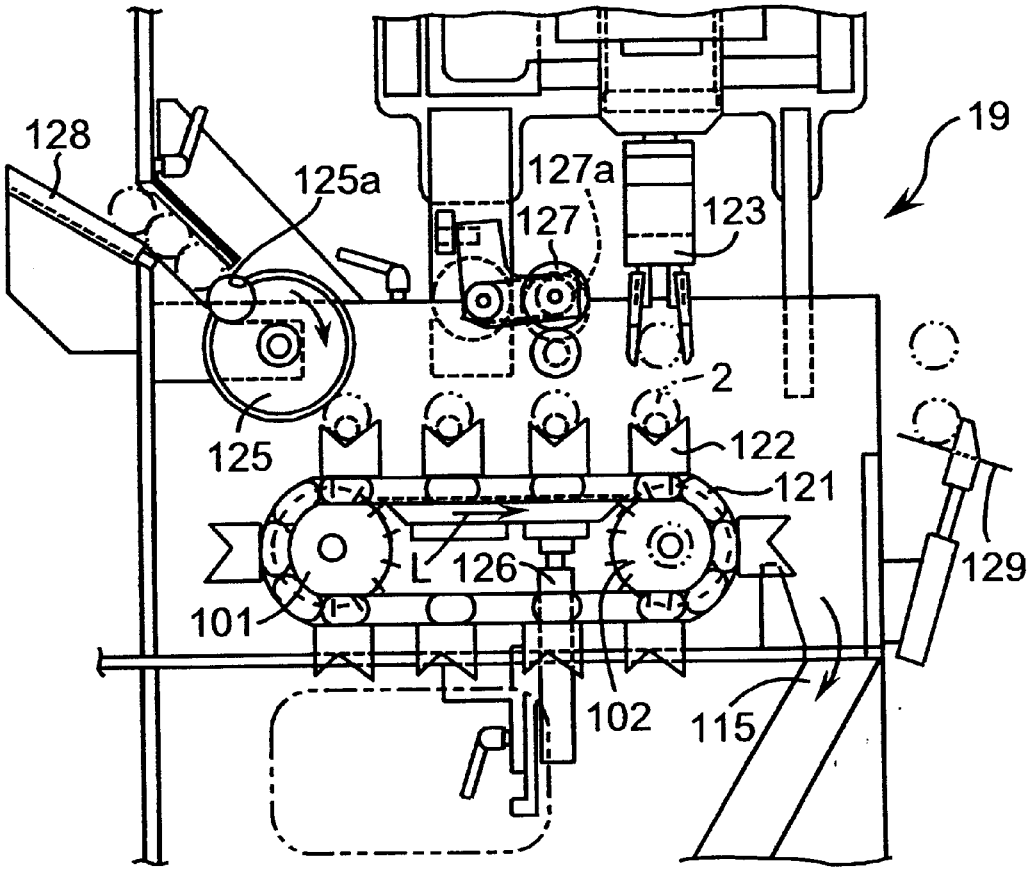
FIG. 12 is a schematic drawing to show a roll shaft supplying apparatus.

As described above, the roll shaft supplying apparatus 19 is arranged to supply the roll shaft 2 having slit 110 to the sheet winding apparatus 18. As shown in FIG. 12, the roll shaft supplying apparatus 19 is provided with a transferring apparatus composed of an endless link 121 stretched between a pair of pulleys 101, 102 and moving in the direction of arrow L, and receivers 122 each fixed to the endless link 121 to receive the roll shaft 2. For the receiver 122 located at the left end of the transferring apparatus, an introducing rotary plate 125 is provided for introducing the roll shaft 2 into the receiver 122. A drive pulley is the pulley 101 out of the pair of pulleys 101, 102.

A holding groove 125*a* for holding the roll shaft 2 is formed in the outer periphery of the introducing rotary plate 125. A roll shaft 2 is held in this holding groove 125*a* and then the introducing rotary plate 125 is rotated, whereby the roll shaft 2 in a feed portion 128 is introduced onto the receiver 122 located at the left end of the transferring apparatus. During rotation of the introducing rotary plate 125 the roll shaft 2 is held in the holding groove 125*a* by a holding plate not shown.

Above the endless link 121 there is provided a slit detecting apparatus 127 for detecting whether or not a slit 10 to be formed in the roll shaft 2 is formed at a predetermined end of the roll shaft 2. Further, below the slit detecting apparatus 127 there is provided an air cylinder 126 for lifting the roll shaft 2 on the receiver 122 up to the slit detecting apparatus 127 and thereafter dropping it down to the receiver 122.

Further, provided on the downstream side of the slit detecting apparatus 127 and above the endless link 121 is a gripping/turning apparatus 123 for gripping the roll shaft 2 on the receiver 122 and transferring it to a discharging apparatus 129. This gripping/turning apparatus 123 operates based on a signal from the slit detecting apparatus 127 in such a manner that if the slit 110 is formed at the predetermined end of the roll shaft 2 (i.e., if the slit 119 is formed and if the orientation of the roll shaft 2 is correct), the apparatus grips the roll shaft 2 on the receiver 122 and transfers it to the discharging apparatus 129 without changing the orientation thereof; if the slit 110 is formed on the other end of the roll shaft 2 (i.e., if the slit 110 is formed but the orientation of the roll shaft 2 is opposite), the apparatus grips the roll shaft 2 on the receiver 122, thereafter horizontally turns it 180° and then transfers the thus turned roll shaft 2 to the discharging apparatus 129. Further, if there is no slit 110 formed in the roll shaft 2, the gripping/turning apparatus 123 does not operate, so that the roll shaft 2 on the receiver 122 is disposed of into a disposal part 115 with movement of the endless link 121.

The roll shaft 2 discharged to the discharging apparatus 129 is then transferred to the sheet winding apparatus 18 shown in FIG. 5.

The details of the slit detecting apparatus 127 is next described referring to FIG. 13 and FIGS. 14A–14C. As shown in FIG. 13 and FIGS. 14A–14C, the slit detecting apparatus 127 has an infrared projector 111 and an infrared receiver 112 provided on each of the two ends of the roll shaft 2, as arranged to detect the slit 110 by the infrared projector 111 and infrared receiver 112. The infrared receiver 112 is connected to an amplifier 113 having a comparator function and the amplifier 113 converts an analog signal from the infrared receiver 112 into a non-contact voltage output. This non-contact voltage output is input into a control unit 114. This control unit 114 drive-controls each of the drive pulley 101, the gripping/turning apparatus 123, the introducing rotary plate 125, and the air cylinder 126.

Figure 13:
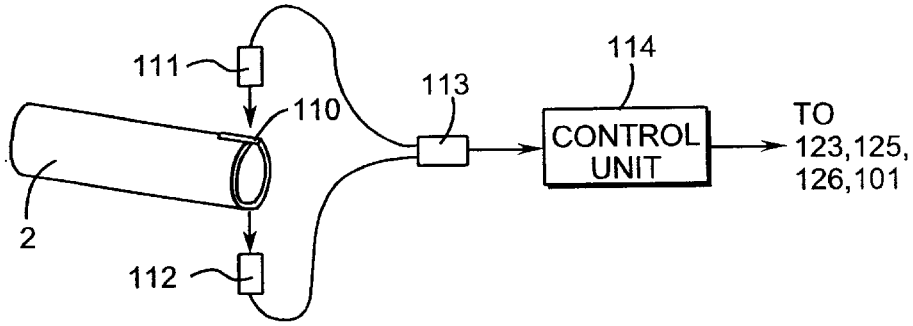
FIG. 13 is a schematic drawing to show a slit detecting apparatus.

Although FIG. 13 shows only a set of infrared projector 111 and infrared receiver 122 provided at one end of roll shaft 2 for convenience sake, there are two sets actually provided on either end of roll shaft 2. In the slit detecting apparatus 127, a pair of rollers (not shown) provided at the upper end of the air cylinder 126 shown in FIG. 12 rotatably support the roll shaft 2 and at the same time, the roll shaft 2 rotates as urged downward by a drive roll 127*a* of the slit detecting apparatus 127.

The operation of the roll shaft supplying apparatus 19 is next described. First, as shown in FIG. 12, a roll shaft 2 with slit 110 fed to the feed portion 128 is made to fit in the holding groove 125*a* formed in the outer periphery of the introducing rotary plate 125. The introducing rotary plate 125 next rotates clockwise, whereby the roll shaft 2 fit in the holding groove 125*a* is introduced onto a receiver 122 at the left end, fixed to the endless link 121. During this period, the endless link 121 is intermittently moved in the direction of arrow L by the drive pulley 101 to transfer the roll shaft 2 on the receiver 122 to the right in FIG. 12.

When the roll shaft 2 on the receiver 122 comes to immediately below the slit detecting apparatus 127, the endless link 121 stops. The roll shaft 2 is then lifted up by the air cylinder 126 to rise to the slit detecting apparatus 127.

Figure 14A:
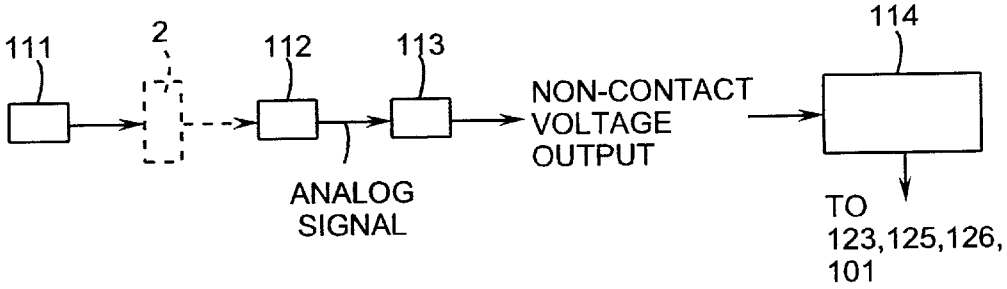
FIGS. 14A, 14B, and 14C are drawings to show a flow of a signal and an amplitude thereof in the slit detecting apparatus.
Figure 14B:
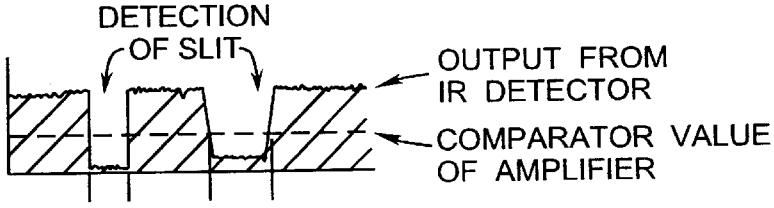

In the slit detecting apparatus 127, the roll shaft 2 rotates as held by the above rotating mechanism. During this period, infrared rays are projected from the infrared projectors 111 to the both ends of the roll shaft 2. In case of the slit 110 being formed in the roll shaft 2, as shown in FIG. 14A, the infrared rays projected from the infrared projector 111 are directly received by the infrared receiver 112 through the slit 110, and an analog signal from the infrared receiver 112 is converted into a non-contact voltage output by the amplifier 113. The non-contact voltage output from the amplifier 113 is then input into the control unit 114. FIG. 14B shows the output from the infrared receiver 112 on this occasion and a comparator value of the amplifier, and FIG. 14C shows an output from the amplifier 113.

Figure 14C:
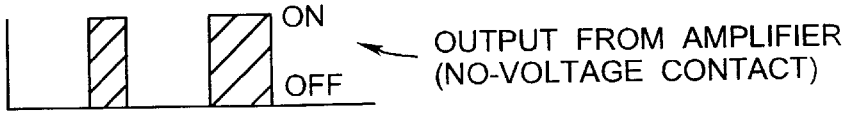

As shown in FIGS. 14A, 14B, and 14C, the slit 110 in the roll shaft 2 is represented by an output from the amplifier 113, whereby the control unit 114 can check absence or presence of the slit 110 in the roll shaft 2. Since the infrared projectors 111 and infrared receivers 112 are set on either end of the roll shaft 2 as described above, it can be checked which side has the slit 110 in the roll shaft 2 or in which way the roll shaft 2 is oriented when the control unit 114 specifies which infrared receiver 112 outputs a signal.

As shown in FIG. 12, the air cylinder 126 then drops to return the roll shaft 2 to the receiver 122 and then the endless link 121 moves in the direction of arrow L. Next, when the roll shaft 2 on the receiver 122 comes to immediately below the gripping/turning apparatus 123, the endless link 121 stops and the gripping/turning apparatus 123 descends to grip the roll shaft 2 on the receiver 122.

The gripping/turning apparatus 123 performs the following operation based on a signal from the control unit 114. If the slit 110 is formed in the roll shaft 2 and if the orientation of the roll shaft 2 is correct, the gripping/turning apparatus 123 drops to grip the roll shaft 2 on the receiver 122. After that, the gripping/turning apparatus 123 ascends to transfer the roll shaft 2 to the discharging apparatus 129 without changing the orientation. The roll shaft 2 transferred to the discharging apparatus 129 is then conveyed to the winding portion 18 shown in FIG. 5.

In contrast, if the slit 110 is formed in the roll shaft 2 and if the orientation of the roll shaft 2 is opposite, the gripping/turning apparatus 123 drops to grip the roll shaft 2 on the receiver 122. After that, the gripping apparatus 123 ascends to horizontally turn the roll shaft 2 180° and thereafter transfers the roll shaft 2 to the discharging apparatus 129.

If there is no slit 110 formed in the roll shaft 2, the gripping/turning apparatus 123 does not operate and the endless link 121 moves in the direction of arrow L in FIG. 12. With the movement the roll shaft 2 on the receiver 122 is disposed of as a defective to the disposal side 115.

In this manner, after it is detected if the slit 110 is formed at the predetermined end of roll shaft 2 and after the orientation of roll shaft 2 is corrected if it is opposite, the roll shaft 2 can be supplied to the winding portion 18. Further, if no slit 110 is formed in the roll shaft 2, it is disposed of to the outside of system without supplying the roll shaft 2 to the winding portion 18.

Figure 15:
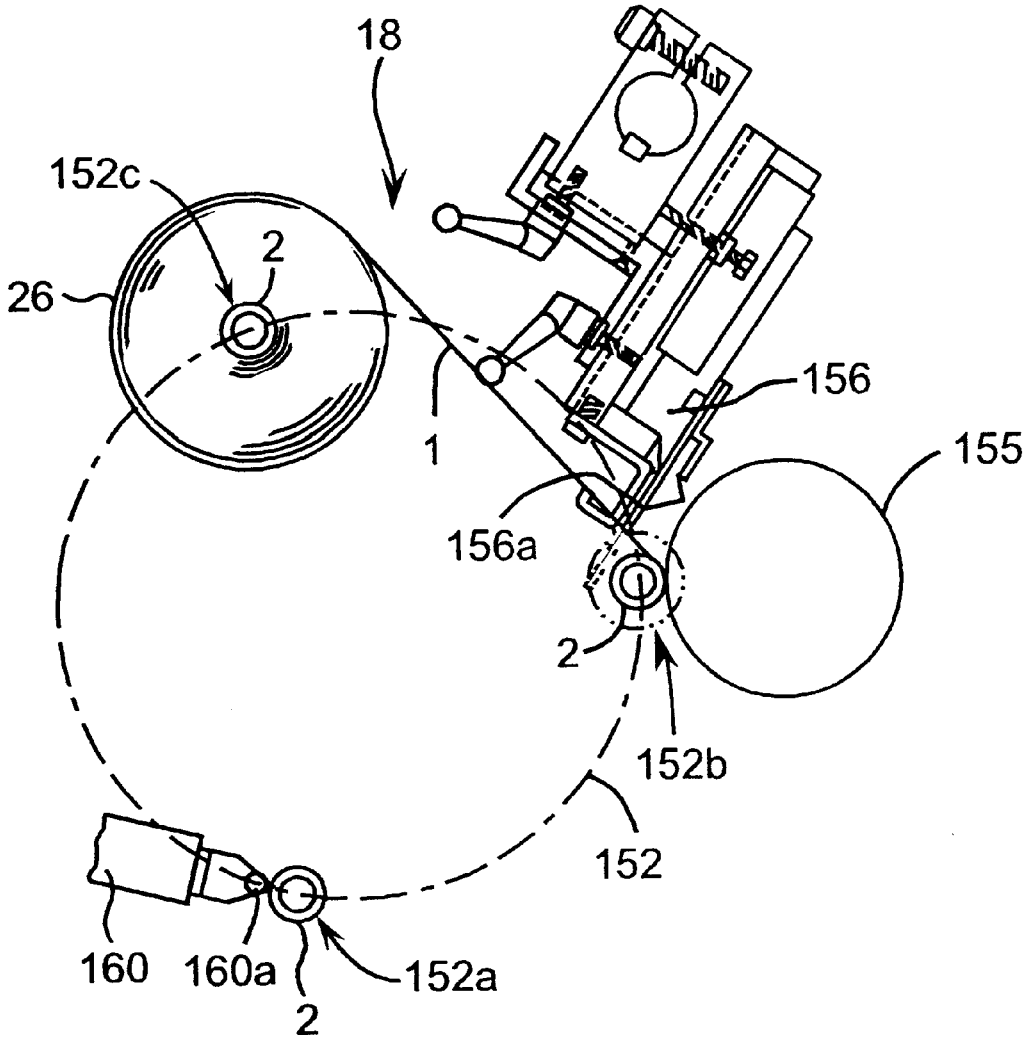
FIG. 15 is a schematic drawing to show a sheet winding apparatus and a sheet roll.
Figure 16:
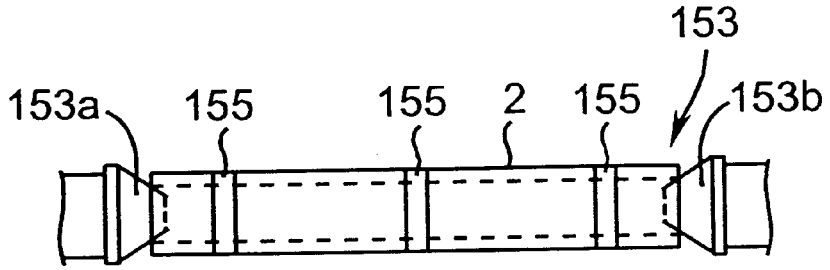
FIG. 16 is a drawing to show a holding/rotating apparatus for holding and rotating a roll shaft.

The sheet winding/discharging apparatus is next described referring to FIG. 5 and FIGS. 18A–18C. The sheet winding/discharging apparatus has four sheet winding devices 18 in total, two each in upper and lower steps, and sheet roll cradles 165, provided in upper and lower steps corresponding to the arrangement steps of the sheet winding devices 18, for the sheet rolls 26 from the sheet winding devices 18 to be mounted thereon. Each sheet winding device 18 has a holding/rotating apparatus 153 composed of a pair of rotary chucks 153*a*, 153*b* for rotating as holding the roll shaft 2 from the both sides thereof, as shown in FIG. 15 and FIG. 16. A plurality of such holding/rotating apparatus 153 are provided on a circular orbit 152 so as to move along the circular orbit 152 and to stop at a sticking position 152*a*, a winding position 152*b*, and a discharging position 152*c* on the circular orbit 152.

Figure 17:
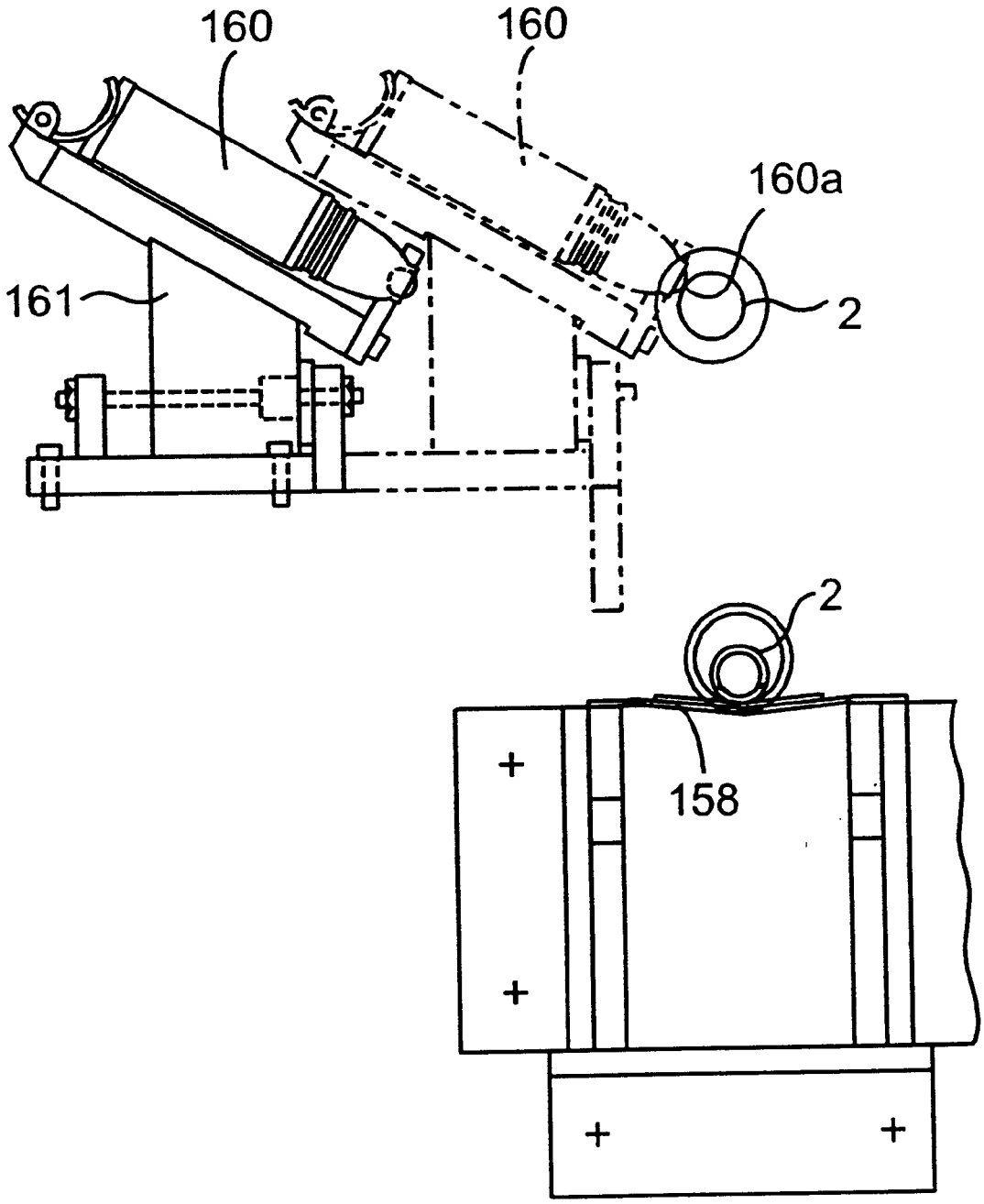
FIG. 17 is a drawing to show a sticking apparatus.

Near the sticking position 152*a*, a sticking apparatus 160 is set so that a fore end portion 160*a* of the sticking apparatus 160 forms for example three sticking parts 155 made of an adhesive along the circumferential direction on the outer periphery of an unused roll shaft 2 (FIG. 16). The sticking apparatus 160 is held by a holding portion 161 as shown in FIG. 17, and the sticking apparatus 160 is arranged to be moved between the position of the solid line and the position of the chain double-dashed line when the holding portion 161 moves left to right in FIG. 17. In FIG. 17, a stage 158 is provided below the roll shaft 2 at the sticking position, and the roll shaft supplied from the roll shaft supplying apparatus 19 (FIG. 5) is temporarily mounted on the mount stage 158.

Also, a press roll 155 for pressing the recording sheet 1 against the roll shaft 2 located at the winding position 152*b* is provided near the winding position 152*b* on the circular orbit 152. Further provided between the winding position 152*b* and the discharging position 152*c* is a cutting apparatus 156 for cutting the recording sheet 1 extending between a sheet roll 26 already wound at the discharging position 152*c* and an unused roll shaft 2 at the winding position 152*b*. This cutting apparatus 156 has a cutter 156*a*, and the recording sheet 1 is cut by moving the cutter 156*a* in the direction perpendicular to the recording sheet 1.

Figure 18A:
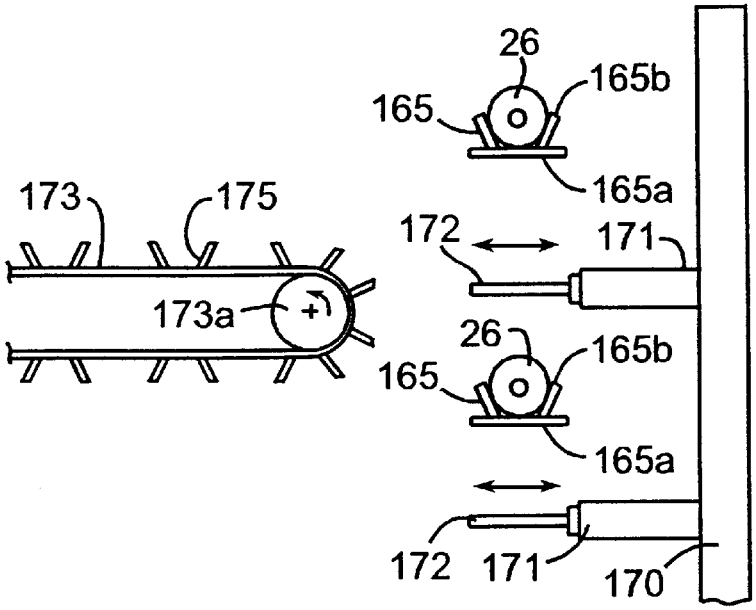
FIGS. 18A, 18B, and 18C are drawings to show a discharging mechanism of sheet roll.
Figure 18B:
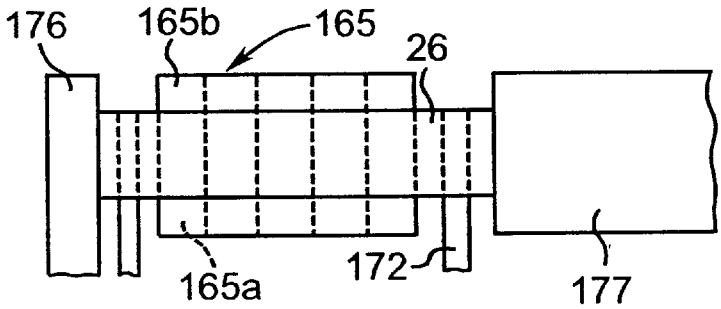
Figure 18C:
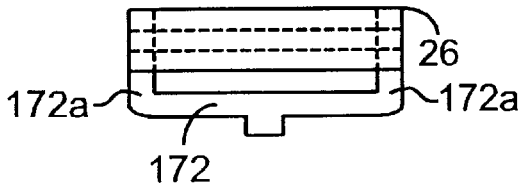

Next described referring to FIGS. 18A, 18B, and 18C is the discharging mechanism of sheet roll 26 including the sheet roll cradles 165. The sheet roll cradles 165 are arranged one each in the upper and lower steps corresponding to the arrangement steps of the sheet winding devices 18 as described above. Sheet rolls 26 obtained by the two sheet winding devices 18 in the upper step are transferred to the sheet roll cradle 165 in the upper step, for example, by a belt conveyor 177, and sheet rolls 26 obtained by the two sheet winding devices 18 in the lower step are transferred to the sheet roll cradle 165 in the lower step.

In the cases where the belt conveyor 177 is used to transfer the rolls 26 to the sheet roll cradles 165, the sheet roll cradles 165 each are preferably composed of rollers. Namely, a sheet roll cradle 165 is composed of a plurality of rollers 165*a* arranged perpendicularly to the transfer direction of sheet roll 26, and holding plates 165*b* for holding the both sides of sheet roll 26. A stopper 176 for stopping the sheet roll 26 is disposed on the opposite side of the sheet roll cradle 165 to the belt conveyor 177.

As shown in FIG. 18A, a carry-out conveyor 173 put around a pulley 173*a* is set beside the sheet roll cradles 165, 165 in the upper and lower steps, and hold claws 175 for holding the sheet rolls 26 are provided on the surface of the carry-out conveyor 173. A guide rail 170 is vertically arranged on the opposite side of the sheet roll cradles 165 to the carry-out conveyor 173, and receiving arms 171 horizontally extending on the side of the sheet roll cradles 165 are attached to the guide rail 170.

A pair of receiving arms 171 are disposed each in upper and lower steps corresponding to the respective sheet roll cradles 165, and the each receiving arm 171 is arranged to move up and down along the guide rail 170 and horizontally extends or contracts. The each receiving arm 171 has a receiving part 172 at the distal end thereof. Further, a pair of receiving arms 171 are located on either side of each sheet roll cradle 165, as shown in FIG. 18B. The receiving parts 172 linearly extend from the receiving arms 171, so that they are located between the sheet roll cradle 165 and the stopper 176 and between the sheet roll cradle 165 and the belt conveyor 177. Then each pair of receiving parts 172 support the both lower ends of sheet roll 26. Another possible arrangement is one as shown in FIG. 18C, in which a fore end of the receiving part 172 is bifurcated into two branches 172*a*, 172*a* on the plan view and the pair of branches 172*a*, 172*a* support the both lower ends of sheet roll 26.

Next described is the operation of the sheet winding/discharging apparatus in the above structure. First, in FIG. 5 and FIG. 17, unused roll shafts 2 from the roll shaft supplying apparatus 19 are temporarily mounted on the upper and lower mount stages 158, and thereafter, the sheet rolls 2 are lifted up by an elevating means not shown to the sticking position 152*a* on the circular orbit 152 of each winding device 18. When the roll shaft 2 reaches the sticking position 152*a* in each winding device 18, it is next held by the holding/rotating apparatus 153 composed of a pair of rotary chucks 153*a*, 153*b*.

Next, the holding portion 161 moves the sticking apparatus 160 to the right in FIG. 17, so that fore ends 160*a* of sticking apparatus 160 come into contact with the outer periphery of roll shaft 2. There are three sticking apparatus 160 along the longitudinal direction of roll shaft 2. Thus, rotating the holding/rotating apparatus 153, three sticking parts 155 made of an adhesive are formed along the circumferential direction on the outer periphery of roll shaft 2.

Then the holding/rotating apparatus 153 moves to the winding apparatus 152*b* along the circular orbit 152. During this period, the sheet roll 26 having been wound at the winding position 152*b* moves from the winding position 152*b* to the discharging position 152*c*. In this case, the recording sheet 1 extends between the sheet roll 26 at the discharging position 152*c* and an unused sheet roll 2 at the winding position 152*b*.

Then the cutter 156*a* of the cutting apparatus 156 approaches the recording sheet 1 to cut the recording sheet 1. Then the recording sheet is urged against the unused roll shaft 2 at the winding position 152*b* of each winding apparatus 18 by the press roll 155, whereby the end portion of recording sheet 1 is fixed to the outer periphery of roll shaft 2. Then the recording sheet 1 is wound around the outer periphery of roll shaft 2 by rotating the holding/rotating apparatus 153. On this occasion the press roll 155 rotates always in contact with a sheet roll so as to function as an air bleeding mechanism for bleeding air in the sheet roll. Thus, four sheet rolls 26 in total (FIG. 1 and FIG. 15) are formed at the winding position 152*b* in this manner. The sheet roll 26 obtained at each winding apparatus 18 is then transferred to the discharging position 152*c* as described above, and after cutting the rear end recording sheet 1, the sheet roll is discharged by a discharging means, for example such as a belt conveyor 177, from the discharging position 152*c* to the sheet roll cradle 165 (FIG. 5 and FIG. 18) provided corresponding to each step. In this case, the sheet roll 26 slides on the rollers 165*a* of sheet roll cradle 165 and then is stopped at a predetermined position by the stopper 176.

Next described is the operation of transferring the sheet rolls 26 on the sheet roll cradles 165, 165 provided in the upper and lower steps onto the carry-out conveyor 173, as shown in FIGS. 18A–18C. As shown in FIG. 18A, the two pairs of receiving arms 171 in total provided in the upper and lower steps are first withdrawn to the position of FIG. 18A. After that, the each receiving arm 171 ascends and then the pair of receiving arms 171 support the both lower ends of sheet roll 26 on the corresponding sheet roll cradle 165 to lift it up. Then the each receiving arm 171 further ascends, so that either of the paired receiving arms 171 in the upper and lower steps reach above the carry-out conveyor 173.

Then each receiving arm 171 extends toward the carry-out conveyor 173 and thereafter each receiving arm 171 descends. In this case, the sheet roll 26 on the paired receiving arms 171 in the lower step is first mounted on the carry-out conveyor 173 to be held by the hold claws 175. Then the paired receiving arms 171 in the lower step continue descending. After that, the sheet roll 26 on the paired receiving arms 171 in the upper step is mounted on the carry-out conveyor 173 to be held by the hold claws 175, and the paired receiving arms 171 in the upper step continue descending.

Since the each receiving arms 171 passes beside the carry-out conveyor 173 when the paired receiving arms 171 pass the carry-out conveyor 173, the receiving arms 171 will not interfere with the carry-out conveyor 173.

As described above, the sheet rolls 26 can be readily transferred from the sheet roll cradles 165 in the upper and lower steps corresponding to the arrangement steps of the sheet winding devices 18, onto a single-step carry-out conveyor 173. Since the apparatus has such an arrangement that the sheet winding devices 18 are arranged in the two steps and that the sheet rolls 26 formed by the respective sheet winding devices 18 can be gathered on one single-step carry-out conveyor 173, the constituent members can be set in a compact arrangement and the discharging path of sheet rolls 26 can be simplified.

What is claimed is:

1. A sheet winding/discharging apparatus comprising:

a plurality of sheet winding devices arranged in multiple steps in a vertical direction, each sheet winding device for winding a sheet around a roll shaft to form a sheet roll;

a plurality of sheet roll cradles arranged in multiple steps in the vertical direction corresponding to the steps in which said sheet winding devices are arranged, on each of which said sheet roll from each sheet winding device is to be mounted;

a carry-out conveyor provided beside said sheet roll cradles;

a guide rail disposed beside said sheet roll cradles on an opposite side to said carry-out conveyor and arranged in the vertical direction; and receiving arms horizontally mounted to the guide rail corresponding to the sheet roll cradles, each receiving arm vertically moving along the guide rail and horizontally extending or contracting, and each receiving arms, when extended, receiving said sheet roll on the sheet roll cradle to transfer the sheet roll onto said carry-out conveyor.

2. A heat transfer recording sheet producing apparatus comprising:

a web supplying apparatus for supplying a web having a base film and a hot melt ink layer;

a gravure printing apparatus for printing a plurality of end marks at predetermined intervals in the widthwise direction on the web supplied from the web supplying apparatus;

a drying apparatus for drying the gravure-printed end marks;

a sheet winding apparatus for winding a sheet obtained from said web in a roll form around a roll shaft having a slit found in one end thereof to form a sheet roll;

a roll shaft supplying apparatus for supplying the roll shaft to said sheet winding apparatus; and a discharging apparatus for discharging the sheet roll formed by said sheet winding apparatus, wherein:

(1) said sheet winding apparatus comprises sheet winding devices arranged in multiple steps in a vertical direction and (2) said discharging apparatus comprises:

a plurality of sheet roll cradles arranged in multiple steps in the vertical direction corresponding to the steps in which said sheet winding devices are arranged, on each of which said sheet roll from each sheet winding device is to be mounted;

a carry-out conveyor provided beside said sheet roll cradles;

a guide rail disposed beside said sheet roll cradles on an opposite side to said carry-out conveyor and arranged in the vertical direction; and receiving arms horizontally mounted to the guide rail corresponding to the sheet roll cradles, each receiving arm vertically moving along the guide rail and horizontally extending or contracting from said sheet roll cradles, to said carry-out conveyor, and each receiving arm, when extended, receiving said sheet roll on the sheet roll cradle to transfer the sheet roll onto said carry-out conveyor.

3. A heat transfer recording sheet producing apparatus comprising:

a web supplying apparatus for supplying a web having a base film and a hot melt ink layer;

a sheet winding apparatus for winding a sheet obtained from said web in a roll form around a roll shaft having a slit formed in one end thereof to form a sheet roll;

a roll shaft supplying apparatus for supplying said roll shaft to the sheet winding apparatus; and a discharging apparatus for discharging the sheet roll formed by said sheet winding apparatus, wherein (1) said sheet winding apparatus comprises sheet winding devices arranged in multiple steps in a vertical direction and (2) said discharging apparatus comprises:

a plurality of sheet roll cradles arranged in multiple steps in the vertical direction corresponding to the steps in which said sheet winding devices are arranged, on each of which said sheet roll from each sheet winding device is to be mounted;

a carry-out conveyor provided beside said sheet roll cradles;

a guide rail disposed beside said sheet roll cradles on an opposite side to said carry-out conveyor and arranged in the vertical direction; and receiving arms horizontally mounted to the guide rail corresponding to the sheet roll cradles, each receiving arm vertically moving along the guide rail and horizontally extending or contracting from said sheet roll cradles to said carry-out conveyor, and each receiving arm, when extended, receiving said sheet roll on the sheet roll cradle to transfer the sheet roll onto/said carry-out conveyor.

* * * * *